United States Patent [19]

Ostand

[11] 4,276,916

[45] Jul. 7, 1981

[54] SENSING ARRANGEMENTS FOR SENSING THE PRESENCE OF LIQUID IN A VAPOR LINE

[75] Inventor: Paul R. Ostand, Cincinnati, Ohio

[73] Assignee: Dover Corporation, New York, N.Y.

[21] Appl. No.: 45,202

[22] Filed: Jun. 4, 1979

[51] Int. Cl.[3] ..... B65B 3/18; B65B 57/14

[52] U.S. Cl. ..... 141/206; 116/228; 137/199; 137/558; 141/212; 141/226

[58] Field of Search ..... 73/322.5; 116/228; 137/197, 199, 200, 403, 558; 141/1, 59, 95, 198, 206–229, 285, 290, 301, 302, 303, 307, 392

[56] References Cited

U.S. PATENT DOCUMENTS

| | | | |
|---|---|---|---|
| 4,049,029 | 9/1977 | Hansel | 141/206 |
| 4,062,384 | 12/1977 | Frahm | 141/302 X |
| 4,072,934 | 2/1978 | Hiller | 141/95 X |
| 4,090,539 | 5/1978 | Krupp | 141/198 |
| 4,098,306 | 7/1978 | Askevold | 141/218 |
| 4,167,957 | 9/1979 | Voelz et al. | 141/198 X |

*Primary Examiner*—Frederick R. Schmidt
*Attorney, Agent, or Firm*—Kinney and Schenk

[57] ABSTRACT

An automatic shut-off nozzle has liquid flow through its vapor return means stopped in response to movement of an actuator by a flexible diaphragm when liquid has filled the vapor line sufficiently to move a float into engagement with the diaphragm. The actuator produces a signal to cause stopping of liquid flow through the nozzle. In another embodiment, a flexible diaphragm is positioned to block vapor flow through the vapor return means when a predetermined quantity of liquid is collected by the diaphragm. The blocking of the vapor return means creates an increased pressure, which can be sensed by a pressure transducer, for example, with the pressure transducer producing a signal to stop liquid flow through the nozzle. The automatic shut-off nozzle also stops flow in response to the tank being filled to a predetermined level with liquid or to the pressure in the tank exceeding a predetermined pressure.

24 Claims, 5 Drawing Figures

SENSING ARRANGEMENTS FOR SENSING THE PRESENCE OF LIQUID IN A VAPOR LINE

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be returned to the tank from which the liquid is supplied.

However, the level of the gasoline within the vehicle tank being filled cannot be viewed because of the sealing of the fill pipe opening. Therefore, it is necessary for there to be automatic shut off of the supply of gasoline with a nozzle having a vapor recovery arrangement.

The automatic shut-off mechanism, which automatically stops the supply of gasoline to the vehicle tank, depends upon the level of the liquid in the tank reaching a predetermined level at which it blocks a vacuum passage opening in the nozzle spout to cause activation of release means to move the main poppet valve, which is controlling liquid flow from the inlet of the nozzle body through the nozzle body, to its closed position. However, because of the angles of the fill pipes of certain vehicles, the spout may be so disposed within the fill pipe that the vacuum passage opening in the nozzle spout cannot be blocked by the level of the gasoline in the vehicle tank prior to the gasoline flowing through vapor return means in the nozzle body.

Because of the vapor return seal sealing the fill pipe opening, the attendant cannot see the pitch of the nozzle spout within the fill pipe. Thus, the attendant cannot position the nozzle spout within the fill pipe so that the vacuum passage opening in the nozzle spout would be located so as to be blocked by the level of the gasoline in the tank prior to the gasoline in the tank escaping therefrom through the vapor return means in the nozzle body.

Accordingly, if the vacuum passage opening in the nozzle spout is not blocked by the level of the gasoline in the tank prior to the gasoline being able to flow through the vapor return means in the nozzle body, gasoline would be pumped through the fill pipe to the tank and then returned to the tank from which the liquid is supplied through the vapor return means in the nozzle body and a vapor line. As a result, the customer would pay for gasoline not received since the pumping of gasoline is utilized to determine the quantity supplied to the customer.

The present invention satisfactorily solves the foregoing problems through providing an arrangement in which the presence of a predetermined quantity of liquid at a predetermined location results in a flexible diaphragm being moved. In one embodiment, the flexible diaphragm is moved by a float with the flexible diaphragm causing an actuator to be moved to produce a signal to automatically stop flow of liquid through the nozzle. In another form, the flow of liquid through the vapor line is blocked so that pressure increase in the blocking area is sensed by a pressure transducer, for example. Thus, flow of liquid is stopped even when the vacuum passage opening in the nozzle spout cannot be blocked by the level of the liquid in the tank because of the angle of the fill pipe.

With the present invention, the automatic shut-off nozzle is still responsive to the blocking of the vacuum passage opening in the nozzle spout when the liquid in the tank reaches the predetermined level. Therefore, the present invention enables the automatic shut-off nozzle to continue to be effective when the spout opening is blocked by the level of the liquid in the tank.

With the present invention, the automatic shut-off nozzle also is still responsive to the pressure in the tank exceeding a predetermined pressure. Accordingly, the automatic shut-off nozzle of the present invention is still responsive to the two conditions within the tank being filled.

An object of this invention is to sense or detect the presence of liquid in a vapor line.

Another object of this invention is to provide an arrangement for automatically stopping liquid flow to a tank or the like when liquid is detected or sensed in a vapor line communicating with the tank.

A further object of this invention is to provide an arrangement to prevent recirculation of liquid through a tank being filled from a supply source and a vapor line.

Other objects, uses, and advantages of this invention are apparent upon a reading of this description which proceeds with reference to the drawings forming part thereof and wherein.

Figure 1:
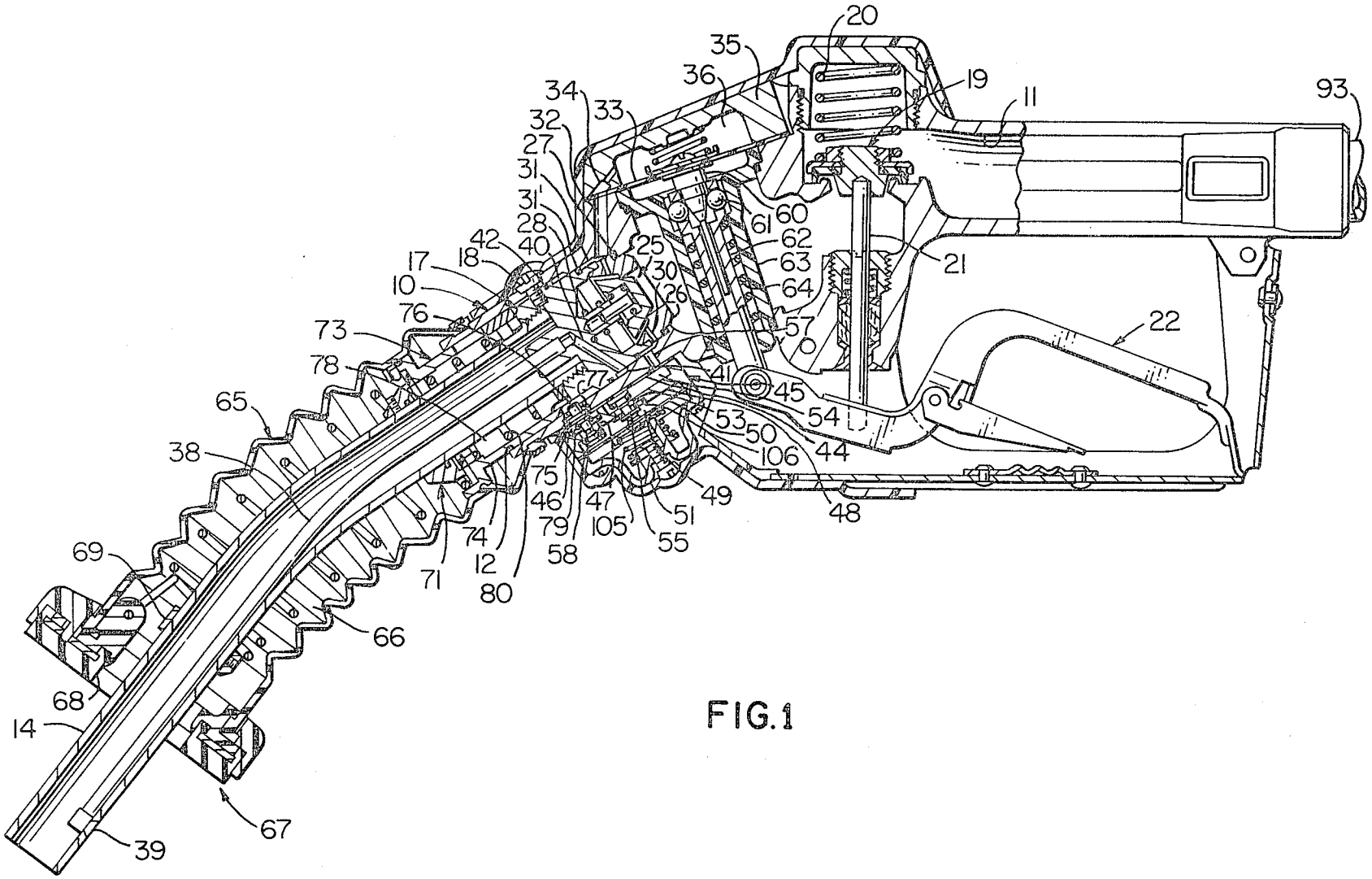
FIG. 1 is a sectional view, partly in elevation, of an automatic shut-off nozzle utilized with the sensing arrangement of the present invention.

Referring to the drawings and particularly FIG. 1, there is shown a nozzle body 10 having an inlet 11 to which a hose 11' (see FIG. 3) is connected to supply liquid such as gasoline, for example, to the interior of the body 10. The body 10 has an outlet 12 with which a spout 14 communicates to receive liquid from the interior of the body 10.

The spout 14, which is adapted to be inserted within an opening 15 (see FIG. 2) in a fill pipe 16 of a vehicle tank such as an automobile fuel tank, for example, has an end threaded in a spout adapter 17 (see FIG. 1). The spout adapter 17 is connected to the outlet 12 of the body 10 by a screw 18.

The body 10 has a first or main poppet valve 19 supported therein for control of the flow of liquid from the inlet 11 to the interior of the body 10 and from the interior of the body 10 to the outlet 12. A spring 20 continuously urges the first poppet valve 19 to its closed position in which flow from the inlet 11 to the outlet 12 is stopped or prevented.

A valve stem 21 is connected to the first poppet valve 19 and has its lower portion extending exteriorly of the body 10. The valve stem 21, which is slidably disposed within the body 10, is moved by a manually operated lever or handle 22. The valve stem 21 passes through the body 10 in the same manner as described in U.S. Pat. No. 3,811,486 to Wood.

A second poppet valve 25 is slidably mounted on the spout adapter 17 and is continuously urged into engagement with a seat ring 26, which is secured to the spout adapter 17 by a threaded connection, by a spring 28. A sealing ring 27 is disposed between the seat ring 26 and the body 10 to prevent liquid leakage therebetween. Thus, only the pressure of liquid going from the inlet 11 and past the first poppet valve 19 can overcome the spring 28 and move the second poppet valve 25 to an open position.

As the liquid flows between the second poppet valve 25 and the seat ring 26, a venturi effect is created in radially extending passages 30 in the seat ring 26. The outer ends of the passages 30 communicate with an annular chamber 31, which is formed between the body 10, the spout adapter 17, the seat ring 26, the sealing ring 27, and a sealing ring 31'. The passages 30 communicate through the chamber 31, a passage 32 in the body 10, an opening in a diaphragm 33, and a passage 34 in a cap 35 to a chamber 36, which is formed between the diaphragm 33 and the cap 35.

The chamber 31 also communicates with a vacuum tube 38, which is connected with an opening 39 in the spout 14 adjacent the discharge or free end of the spout 14. The vacuum tube 38 communicates through a passage 40 in the spout adapter 17 with a chamber 41, which is formed between the sealing ring 31', a sealing ring 42, the spout adapter 17, and the body 10.

The chamber 41 communicates through a passage (not shown) in the nozzle body 10 and an opening (not shown) in a seal 44, which is disposed between the body 10 and a housing 45 secured to the body 10, to a horseshoe-shaped passage 46 in the housing 45. This is more particularly shown in the copending patent application of Jack Alan McMath for "Automatic Shut-Off Nozzle With Vapor Return Seal." Ser. No. 684,441, filed May 7, 1976, refiled as Continuation 856,108, which was refiled as Continuation 943,326, which was refiled as Continuation 059,970 and assigned to the same assignee as the assignee of this application.

The horseshoe-shaped passage 46 in the housing 45 communicates through a passage 47 in a divider 48 of the housing 45 with a chamber 49, which is formed between the divider 48 and a diaphragm 50. A retainer 51 holds the diaphragm 50 on the housing 45.

The chamber 49 communicates through a passage 53 in the divider 48 of the housing 45 with a chamber 54, which is formed within the housing 45 between the divider 48 and the seal 44. The passage 53 is controlled by a poppet valve 55, which is responsive to the diaphragm 50. The chamber 54 communicates through an opening in the seal 44 and a passage 57 in the body 10 with the annular chamber 31.

Accordingly, as long as the poppet valve 55 is open, a poppet valve 58, which controls the passage 47, is open, and the opening 39 is not closed due to the liquid within the tank reaching a predetermined level that indicates that the tank is filled, the venturi effect created by the flow of the liquid between the seat ring 26 and the poppet valve 25 draws air through the vacuum tube 38 to create a partial vacuum within the chamber 36. However, as soon as the opening 39 is blocked or the valve 55 or 58 is closed, the chamber 36 has its pressure reduced due to the air therein being drawn therefrom because of the venturi effect in the passages 30 whereby the diaphragm 33 moves upwardly since the partial vacuum in the chamber 36 is increased. This venturi effect is more particularly described in U.S. Pat. No. 3,085,600 to Briede.

The diaphragm 33 has a latch retaining pin 60 secured thereto for movement therewith and disposed between three balls 61 (two shown), which are positioned within passages in a latch plunger 62. When the latch retaining pin 60 is in the position shown in FIG. 1, the balls 61 prevent downward movement of the latch plunger 62, which is slidably mounted within an insert 63. The insert 63, which is preferably formed of a plastic, is supported in the body 10.

When the diaphragm 33 is moved upwardly due to the increase in the partial vacuum in the chamber 36, the latch retaining pin 60 is moved upwardly therewith. The upward movement of the latch retaining pin 60 disposes a tapered portion of the latch retaining pin 60 between the balls 61 whereby the balls 61 may move inwardly to allow the latch plunger 62 to be moved downwardly against the force of its spring 64. The correlation between the tapered portion of the latch retaining pin 60 and the latch plunger 62 is more specifically shown in U.S. Pat. No. 2,582,195 to Duerr.

The lower end of the latch plunger 62 is connected to the handle 22 as more particularly shown and described in U.S. Pat. No. 3,817,285 to Wilder et al. Thus, when the diaphragm 33 moves upwardly to pull the latch retaining pin 60 and release the latch plunger 62 from the balls 61, the force of the spring 20 closes the main poppet valve 19 as more particularly shown and described in the aforesaid Wilder et al patent.

The body 10 has a bellows 65, which is preferably formed of a gasoline resistant synthetic rubber or urethane, for example, secured thereto and extending from the outlet 12 of the body 10 towards the free or discharge end of the spout 14. The bellows 65 is disposed in spaced relation to the spout 14 to form an annular passage 66 therebetween. The outer end of the bellows 65 has a sealing means 67 removably connected thereto in the manner more particularly shown and described in the copending patent application of Jack A. McMath for "Liquid Dispensing Nozzle Having Vapor Recovery Sealing Arrangement," Ser. No. 970,814, filed Dec. 18, 1978, and assigned to the same assignee as the assignee of this application. The sealing means 67 has a large central opening 68 to enable the sealing means 67 to slide along the spout 14.

The spout 14 has a latch ring 69 thereon for engagement with a lip 70 (see FIG. 2) of the fill pipe 16 to hold the free end of the spout 14 within the fill pipe 16. The latch ring 69 is secured to the spout 14 by suitable means such as a set screw, for example.

As more particularly shown and described in the copending patent application of Jack A. McMath for "Liquid Dispensing Nozzle Having A Sealing Arrangement For Vapor Return Means," Ser. No. 696,937 filed June 17, 1976 and refiled as Continuation, Ser. No. 856,110, filed Nov. 30, 1977, refiled as Continuation 918,057 on June 22, 1978, and assigned to the same assignee as the assignee of this application, a check valve 71 blocks communication of the annular passage 66 with a tank 72 (see FIG. 3). As more particularly shown and described in the aforesaid McMath application, Ser. No. 856,110, the check valve 71 (see FIG. 1) includes a slidable cylindrical member 73, which has a skirt 74 with a cam surface 75 at its end. The cam surface 75 cooperates with an actuator pin 76, which is supported in a bushing 77 in the body 10.

The annular passage 66 communicates with the tank 72 (see FIG. 3) through an annular passage 78 (see FIG. 2), which is formed between the outer surface of the spout 14 and the skirt 74 of the slidable cylindrical member 73. The annular passage 78 communicates with the tank 72 (see FIG. 3) through a longitudinal cut out portion (not shown) in the skirt 74 (see FIG. 2) and a vapor return passage (not shown) in the body 10 as more particularly shown and described in the aforesaid McMath application, Ser. No. 684,441.

Accordingly, when the spout 14 is disposed in the fill pipe opening 15 so that the sealing means 67 engages the end of the fill pipe 16 to stop movement of the sealing means 67, the continued movement of the spout 14 into the fill pipe opening 15 causes the body 10, which has the spout 14 attached thereto through the spout adapter 17, to move relative to the slidable cylindrical member 73. As a result, the pin 76, which moves with the body 10 because of its disposition within the bushing 77, engages the cam surface 75 of the skirt 74 of the slidable cylindrical member 73. This engagement of the pin 76 with the cam surface 75 cams the pin 76 from the position of FIG. 1 to the position of FIG. 2.

The pin 76 acts through the seal or gasket 44 on one end of the poppet valve 58, which controls the passage 47 in the divider 48 of the housing 45. A spring 79 continuously urges the poppet valve 58 to its closed position of FIG. 1 in which it blocks the passage 47. The spring 79 also urges the pin 76 into the interior of the nozzle body 10 so that the pin 76 cannot be moved out of the bushing 77 except by the cam surface 75.

Thus, when there is relative movement between the slidable cylindrical member 73 and the spout 14 due to the spout 14 being inserted in the fill pipe opening 15 (see FIG. 2) and the sealing means 67 abutting the end of the fill pipe 16 with sufficient force to effectively form a seal around the fill pipe opening 15, the poppet valve 58 is moved to an open position through the pin 76 acting on the end of the poppet valve 58 through the seal or gasket 44. The opening of the poppet valve 58 allows air to flow from the inlet opening 39 in the spout 14 and through the vacuum tube 38, the passage 40 in the spout adapter 17, the annular chamber 41, the passage (not shown) in the body 10, the opening (not shown) in the seal 44, the passage 46 in the housing 45, the passage 47 in the divider 48, the chamber 49, the passage 53 in the divider 48, the chamber 54, the opening in the seal 44, the passage 57 in the body 10, and the annular chamber 31 to the passages 30 in the seat ring 26. This provides a supply of air so that the partial vacuum created in the chamber 36 (see FIG. 1) by the venturi effect is not increased.

Accordingly, the slidable cylindrical member 73 of the check valve 71 allows flow through the body 10 only if the sealing means 67 is in sealing engagement with the end of the fill pipe 16 (see FIG. 2) when the spout 14 is inserted in the fill pipe opening 15 to supply the liquid thereto. If there is not engagement of the sealing means 67 with the end of the fill pipe 16 with sufficient force to form a seal around the fill pipe opening 15, then there will not be the desired relative motion of the spout 14, the spout adapter 17, and the body 10 with respect to the slidable cylindrical member 73. This prevents the poppet valve 58 from being opened so that air is not supplied to the passages 30 in the seat ring 26. This lack of air to the passages 30 in the seat ring 26 causes the partial vacuum in the chamber 36 (see FIG. 1) to increase to close the main poppet valve 19 so that liquid cannot flow through the body 10 and the spout 14.

It should be understood that the main poppet valve 19 must be opened and flow to occur for the partial vacuum to be produced in the chamber 36. However, only a small amount of liquid will flow through the spout 14 before the poppet valve 19 is automatically closed by the increased partial vacuum in the chamber 36. This is because the poppet valve 58 always is closed unless the sealing means 67 (see FIG. 2) is engaging the end of the fill pipe 16 with sufficient force to effectively form a seal around the fill pipe opening 15 and the spout 14 has been inserted into the fill pipe opening 15 a sufficient distance to produce the necessary relative motion to cause the poppet valve 58 to be opened.

Therefore, the poppet valve 58 is closed unless necessary relative motion has occurred. As a result of the poppet valve 58 being closed, opening of the main poppet valve 19 (see FIG. 1) to produce the necessary flow past the passages 30 in the seat ring 26 to produce the partial vacuum in the chamber 36 automatically increases the partial vacuum in the chamber 36 whereby the main poppet valve 19 is automatically closed shortly after being opened.

When the spout 14 is removed from the fill pipe opening 15 (see FIG. 2) so that the sealing means 67 does not engage the end of the fill pipe 16, a return spring 80 produces the relative motion of the spout 14, the spout adapter 17, and the body 10 with respect to the slidable cylindrical member 73. Thus, the slidable cylindrical member 73 moves relative to the actuator pin 76 so that the cam surface 75 on the skirt 74 of the slidable cylindrical member 73 no longer engages the actuator pin 76 whereby the actuator pin 76 can again return into the interior of the body 10 as shown in FIG. 1. When this occurs, the poppet valve 58 is returned to its closed position by the spring 79. Closing of the poppet valve 58 stops air flow through the vacuum tube 38 to the chamber 36 so that the diaphragm 33 is caused to move upwardly to release the latch plunger 62 from the balls 61 whereby the spring 20 closes the main poppet valve 19 to automatically stop flow of liquid through the body 10 if it has not been stopped by the manually operated handle 22.

Figure 2:
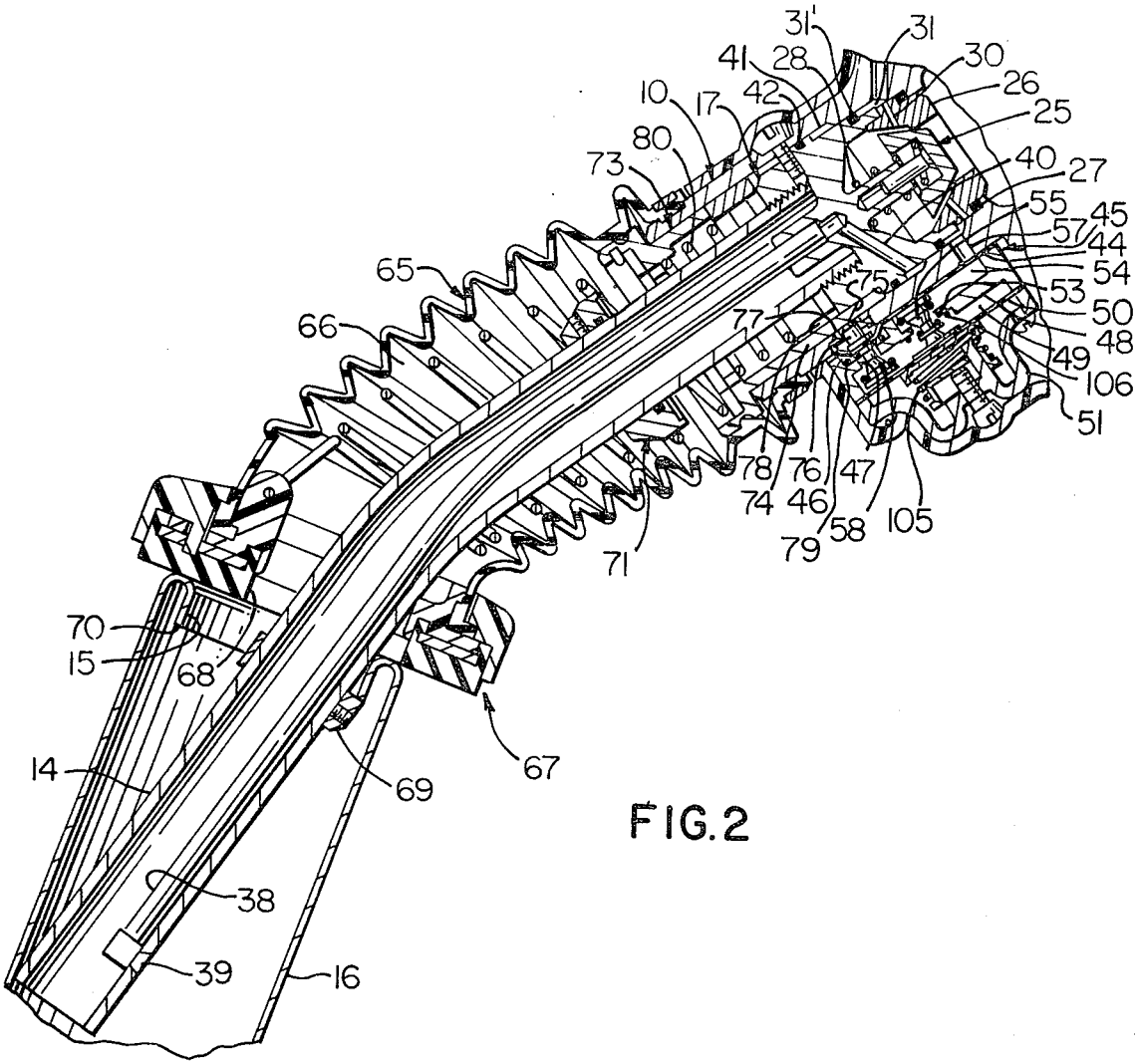
FIG. 2 is a fragmentary sectional view of a portion of the nozzle of FIG. 1 and showing the spout and fill pipe of a vehicle tank with the seal of the vapor return means being effective.
Figure 3:
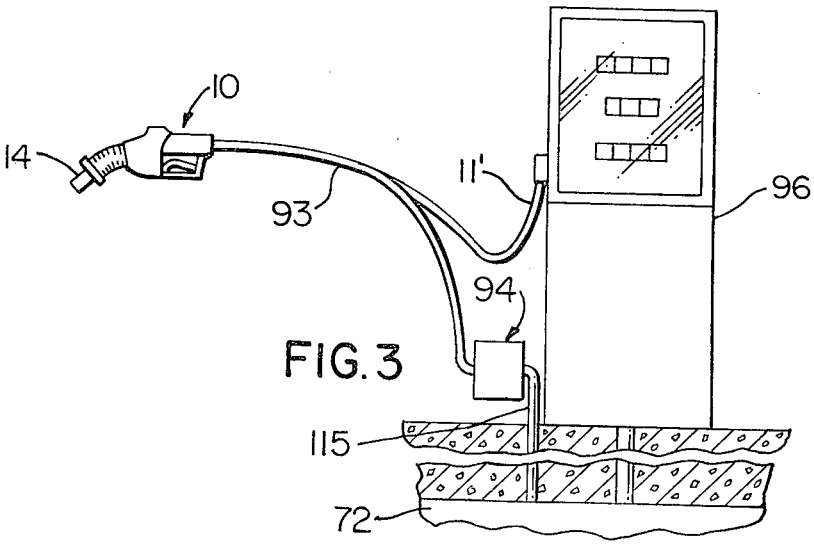
FIG. 3 is a schematic view of the nozzle of FIG. 1 being utilized with one of the sensing arrangements of the present invention.

Accordingly, when the spout 14 is in the position of FIG. 2, vapor within the tank being filled can flow through the opening 15 in the fill pipe 16 and the opening 68 into the annular passage 66 from which it flows to the tank 72 (see FIG. 3). Thus, the movement of the spout 14 (see FIG. 2) into the fill pipe 16 results in the check valve 71 being opened whereby the vapor can be removed from the tank being filled.

The vapor flows through the vapor return passage (not shown) in the nozzle body 10 to a hose 93 (see FIG. 3), which is a vapor return line. The hose 93 communicates through a body 94 with the tank 72 from which the liquid is initially supplied through a pedestal 96 and the hose 11' to the inlet 11 (see FIG. 1) of the nozzle body 10.

As previously mentioned, the poppet valve 55 is responsive to the diaphragm 50, which has a spring 105 acting thereagainst. A spring 106 has one end disposed in a groove in the poppet valve 55 so that the spring 106 urges the poppet valve 55 to its closed position, but the force of the spring 106 is not as strong as the force of the spring 105, which urges the poppet valve 55 to its normally open position through a rivet in the diaphragm 50 being held against the end of the poppet valve 55 by the spring 105.

However, if the vapor pressure in the tank, which is being filled and has the fill pipe opening 15 (see FIG. 2) sealed by the sealing means 67 engaging the end of the fill pipe 16, increases beyond a predetermined pressure, the diaphragm 50 is moved against the force of the spring 105 to permit the poppet valve 55 to move to its closed position in response to the action of the spring 106. When this occurs, air from the opening 39 to the passages 30 in the seat ring 26 is stopped so that the partial vacuum in the chamber 36 (see FIG. 1) is increased to cause automatic closing of the main poppet valve 19. This response of the diaphragm 50 to the vapor pressure in the sealed tank is more particularly shown and described in the aforesaid Wood patent.

Figure 4:
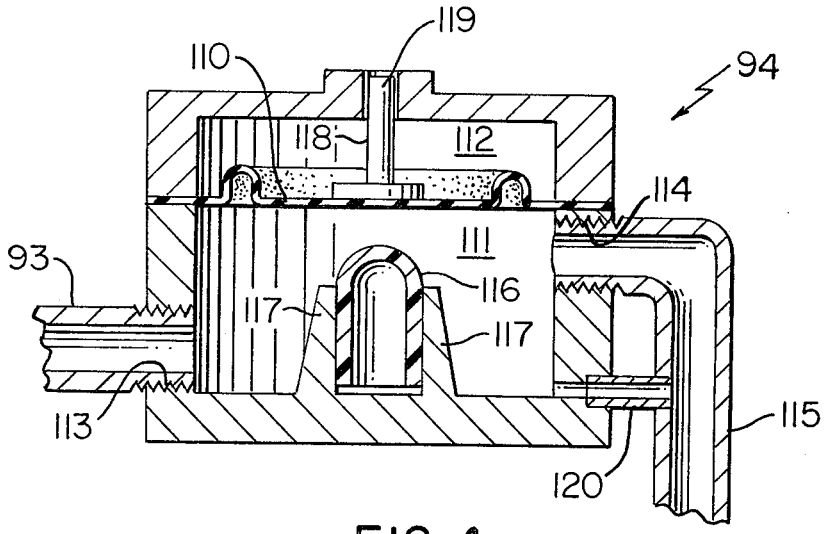
FIG. 4 is a sectional view of one form of the sensing arrangement of the present invention.

As shown in FIG. 4, the body 94 has a flexible diaphragm 110 mounted therein to divide the interior of the body 94 into a lower chamber 111 and an upper chamber 112. The lower chamber 111 has an inlet 113 with which the hose 93 communicates. The lower chamber 111 has an outlet 114, which is higher than the inlet 113, communicating through a conduit 115 with the interior of the tank 72 (see FIG. 3). The conduit 115 supports the body 94 above the tank 72.

A float 116 (see FIG. 4) is supported between a plurality of upstanding ribs 117 within the lower chamber 111 so that the float 116 moves vertically in response to a liquid entering the lower chamber 111. The ribs 117 insure that the float 116 can only move vertically in response to the liquid within the lower chamber 111.

Thus, vapor can flow from the inlet 113 through the lower chamber 111, the outlet 114, and the conduit 115 to the tank 72 (see FIG. 3). However, if liquid enters the lower chamber 111 (see FIG. 4), the float 116 moves upwardly to engage the flexible diaphragm 110 and move it upwardly.

The upward movement of the diaphragm 110 moves an actuator 118, which is secured to the diaphragm 110, upwardly therewith. The actuator 118 has a stem 119, which extends exteriorly of the body 94 when the flexible diaphragm 110 has moved upwardly. Because of the flexible diaphragm 110 sealing the lower chamber 111 from the upper chamber 112, it is not necessary to seal the stem 119 of the actuator 118 as it extends exteriorly of the upper chamber 112.

The stem 119 of the actuator 118 can be utilized with any type of control arrangement to produce the necessary control or signal to indicate that liquid is flowing through the hose 93. For example, the stem 119 can break a light beam in a light sensing device, activate a switch or valve, cause a visual or audible signal to be produced, or control fluid flow by activating a solenoid valve. Any of these various responses to upward movement of the actuator 118 causes the flow of liquid through the nozzle body 10 (see FIG. 1) to be stopped. This could be inactivating the pump, for example, or closing a valve upstream of the main poppet valve 19 (see FIG. 1) and disposed in the line 11'(see FIG. 3), for example.

The lower chamber 111 (see FIG. 4) has a drain passage or conduit 120 extending from the bottom of the lower chamber 111 to the conduit 115. This enables bleeding of the liquid from the lower chamber 111 so that liquid flow through the nozzle body 10 (see FIG. 1) can again be started after the lower chamber 111 (see FIG. 4) has been drained of the liquid therein.

Figure 5:
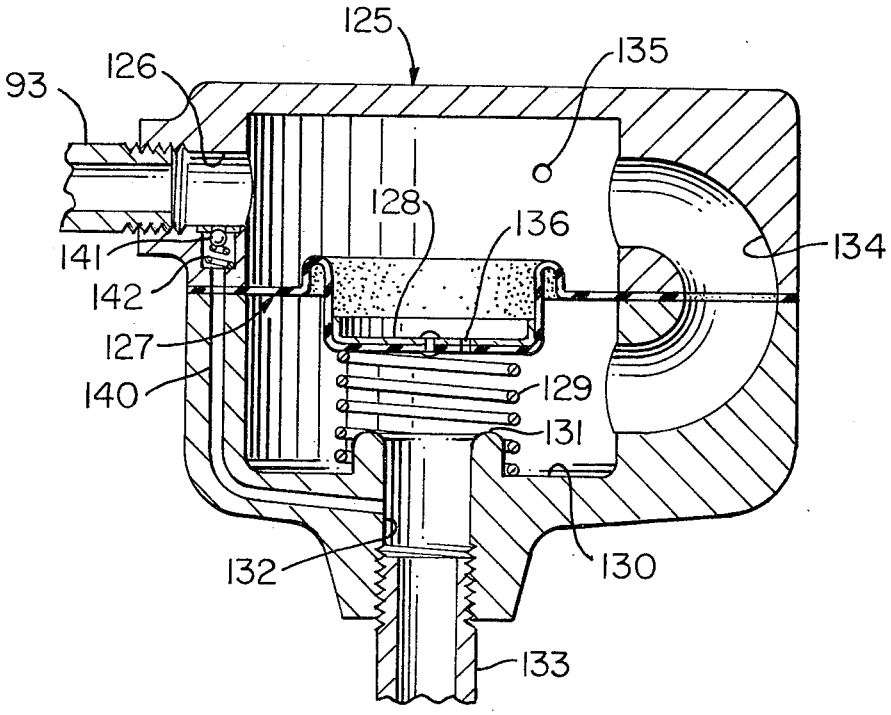
FIG. 5 is a sectional view of another embodiment of the sensing arrangement of the present invention.

Referring to FIG. 5, there is shown a body 125, which replaces the body 94 of FIG. 4. The body 125 has an inlet 126 to which the hose 93 is connected. A flexible diaphragm 127 is supported within the body 125. A metallic cup 128 is supported within the diaphragm 127 to collect liquid therein whenever liquid flows through the inlet 126 into the interior of the body 125.

A spring 129, which acts between a flat surface 130 of the body 125 and the diaphragm 127, continuously urges the diaphragm 127 away from engagement with a seat 131. However, when the cup 128 becomes filled with liquid, the force of the spring 129 is overcome, and the diaphragm 127 moves into engagement with the seat 131 to block flow from the inlet 126 to an outlet 132 of the body 125.

The outlet 132 has a conduit 133, which supports the body 125, leading therefrom to the tank 72 (see FIG. 3). The vapor flows from the inlet 126 (see FIG. 5) to the outlet 132 through a passage 134, which bypasses the diaphragm 127, in the body 125. When sufficient liquid is collected in the cup 128 so that the diaphragm 127 engages the seat 131, neither vapor nor liquid can flow through the outlet 132. However, the liquid would initially be collected in the cup 128 and normally not reach the outlet 132.

When the diaphragm 127 seals against the seat 131 to block flow through the outlet 132 of the body 125, pressure within the body 125 increases. This pressure is sensed through an opening 135, which communicates the interior of the body 125 with a pressure transducer, for example. Thus, the pressure transducer produces a signal to cause stopping of the liquid flow through the nozzle body 10 (see FIG. 1) when the pressure at the opening 135 (see FIG. 5) increases to a predetermined pressure. This can be accomplished through utilizing the electrical signal produced by the pressure transducer to inactivate the pump, for example.

The cup 128 (see FIG. 5) and the flexible diaphragm 127 have a bleed passage 136 therein to enable draining of the liquid from the cup 128. When a predetermined draining of the liquid within the cup 128 has been completed, the spring 129 moves the diaphragm 127 away from engagement with the seat 131 so that vapor can again flow from the inlet 126 through the passage 134 to the outlet 132 in the body 125. This also causes a decrease in the pressure sensed at the opening 135 so that supply of liquid to the nozzle body 10 (see FIG. 1) can again be started.

If desired, the opening 135 (see FIG. 5) could be eliminated, and the increased pressure, which is produced by the diaphragm 127 engaging the seat 131, could be employed to cause closing of the poppet valve 55 (see FIG. 1) due to increasing the pressure within the tank, which is being filled. This would result in the main poppet valve 19 in the nozzle body 10 being moved to its closed position to stop liquid flow.

In this arrangement, it would be necessary to provide a bypass around the seat 131 (see FIG. 5) in the event that the pressure within the hose 93 should increase beyond the desired pressure. Accordingly, a passage 140 in the body 125 could extend from the inlet 126 to the outlet 132 downstream of the seat 131. The passage 140 would have a valve 141 disposed therein and urged to a closed position by a spring 142. Thus, the valve 141 functions as a relief valve to insure that the pressure within the hose 93 does not increase beyond a desired pressure.

An advantage of this invention is that it allows vapor flow through a vapor line without impediment but can stop flow when liquid enters the vapor line. Another advantage of this invention is that it prevents recirculation of liquid through a vapor line. A further advantage of this invention is that it avoids fraud on a customer at a gasoline service station by the operator.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An arrangement for sensing the presence of liquid in a vapor line including a body having an inlet communicating with a source of liquid and vapor and an outlet communicating with an area for receiving vapor, said body having passage means therein connecting said inlet and said outlet, movable means disposed in said body and movable between a first position and a second position, said movable means moving from its first position to its second position when a predetermined quantity of liquid flows into said inlet of said body in a predetermined period of time, and means to sense said movable means in its second position to cause stopping of liquid flow to said inlet of said body.

2. The arrangement according to claim 1 in which said movable means is a flexible diaphragm.

3. The arrangement according to claim 2 including means responsive to the predetermined quantity of liquid to engage said flexible diaphragm to move said flexible diaphragm to its second position when the predetermined quantity of liquid has flowed into the inlet of said body in the predetermined period of time.

4. The arrangement according to claim 3 in which said responsive means includes float means and means to guide the movement of said float means to cause engagement with said flexible diaphragm to move said flexible diaphragm.

5. The arrangement according to claim 4 in which said sensing means includes means movable with said flexible diaphragm.

6. The arrangement according to claim 2 in which said sensing means includes means movable with said flexible diaphragm.

7. The arrangement according to claim 1 in which said movable means forms at least a portion of a wall of said passage means.

8. An automatic shut-off nozzle comprising a body having an inlet and an outlet, valve means in said body controlling flow of liquid from said inlet to said outlet, means controlling the operation of said valve means, a spout communicating with said outlet and having its free end for disposition in an opening of a fill pipe of a tank or the like, means to return vapor from the tank being filled, sealing means to form a seal between the fill pipe opening and said vapor return means when said spout is disposed in the fill pipe, said vapor return means including a body having its inlet communicating with the tank being filled and its outlet communicating with an area for receiving vapor, said body having passage means therein connecting said inlet of said body and said outlet of said body, movable means disposed in said body and movable between a first position and a second position, said movable means moving from its first position to its second position when a predetermined quantity of liquid flows into said inlet of said body in a predetermined period of time, and means to sense said movable means in its second position to cause stopping of liquid flow to said inlet of said nozzle body.

9. The nozzle according to claim 8 in which said movable means is a flexible diaphragm.

10. The nozzle according to claim 9 including means responsive to the predetermined quantity of liquid to engage said flexible diaphragm to move said flexible diaphragm to its second position when the predetermined quantity of liquid has flowed into the inlet of said body in the predetermined period of time.

11. The nozzle according to claim 10 in which said responsive means includes float means and means to guide the movement of said float means to cause engagement with said flexible diaphragm to move said flexible diaphragm.

12. The nozzle according to claim 11 in which said sensing means includes means movable with said flexible diaphragm.

13. The nozzle according to claim 9 in which said sensing means includes means movable with said flexible diaphragm.

14. The nozzle according to claim 8 in which said movable means forms at least a portion of a wall of said passage means.

15. An automatic shut-off nozzle comprising a body having an inlet and an outlet; valve means in said body controlling flow of liquid from said inlet to said outlet; means controlling the operation of said valve means; a spout communicating with said outlet and having its free end for disposition in an opening of a fill pipe of a tank or the like; means to return vapor from the tank being filled; sealing means to form a seal between the fill pipe opening and said vapor return means when said spout is disposed in the fill pipe; said vapor return means including a body having its inlet communicating with the tank being filled and its outlet communicating with an area for receiving vapor; said body having passage means therein connecting said inlet of said body and said outlet of said body; movable means disposed in said body and movable between a first position and a second position, said movable means moving from its first position to its second position when a predetermined quantity of liquid flows into said inlet of said body in a predetermined period of time; means to sense said movable means in its second position to cause stopping of liquid flow to said inlet of said nozzle body; said controlling means including manually operated means controlling the operation of said valve means, release means to release said manual operated means to allow closing of said valve means to stop liquid flow through said body, a chamber, and flexible means forming a wall of said chamber and having said release means connected thereon; communicating means communicating said chamber with the tank being filled; means to create a partial vacuum in said chamber when liquid is flowing through said body; means to block said communicating means when the pressure in the sealed tank being filled exceeds a predetermined pressure; and said sensing means including means to block said vapor return means when the predetermined quantity of liquid flows at the predetermined location in the predetermined period of time to cause an increase in the pressure in the sealed tank beyond the predetermined pressure to cause said blocking means in said communicating means to block said communicating means to increase the partial vacuum in said chamber to move said release means to release said manual operated means to close said valve means.

16. The nozzle according to claim 15 in which said sensing means includes means to limit the pressure in said vapor return means upstream of said blocking means of said sensing means when said blocking means of said sensing means is in its blocking position.

17. The nozzle according to claim 16 in which said blocking means of said sensing means is a flexible diaphragm.

18. The nozzle according to claim 15 in which said blocking means of said sensing means is a flexible diaphragm.

19. An arrangement for sensing the presence of liquid in a vapor line including a body having an inlet communicating with a source of liquid and vapor and an outlet communicating with an area for receiving vapor, said body having passage means therein connecting said inlet and said outlet, movable means disposed in said body and movable between a first position and a second position, said movable means moving from its first position to its second position when a predetermined quantity of liquid flows into said inlet of said body in a predetermined period of time, said movable means blocking said passage means when said movable means is in its second position, and means to sense said movable means in its second position to cause stopping of liquid flow to said inlet of said body.

20. The arrangement according to claim 19 in which said sensing means includes means to sense the pressure in said passage means when said movable means is in its second position.

21. The arrangement according to claim 20 in which said movable means is a flexible diaphragm.

22. An automatic shut-off nozzle comprising a body having an inlet and an outlet, valve means in said body controlling flow of liquid from said inlet to said outlet, means controlling the operation of said valve means, a spout communicating with said outlet and having its free end for disposition in an opening of a fill pipe of a tank or the like, means to return vapor from the tank being filled, sealing means to form a seal between the fill pipe opening and said vapor return means when said spout is disposed in the fill pipe, said vapor return means including a body having its inlet communicating with the tank being filled and its outlet communicating with an area for receiving vapor, said body having passage means therein connecting said inlet of said body and said outlet of said body, movable means disposed in said body and movable between a first position and a second position, said movable means moving from its first position to its second position when a predetermined quantity of liquid flows into said inlet of said body in a predetermined period of time, said movable means blocking said passage means when said movable means is in its second position, and means to sense said movable means in its second position to cause stopping of liquid flow to said inlet of said nozzle body.

23. The nozzle according to claim 22 in which said sensing means includes means to sense the pressure in said passage means when said movable means is in its second position.

24. The nozzle according to claim 23 in which said movable means is a flexible diaphragm.

* * * * *